US006079847A

United States Patent [19]

Nelson

[11] Patent Number: 6,079,847

[45] Date of Patent: Jun. 27, 2000

[54] PROGRAMMABLE SIGNAL LIGHT

[76] Inventor: Chad Carl Nelson, 2651 Fairlawn Dr., Stillwater, Minn. 55082

[21] Appl. No.: 09/164,722

[22] Filed: Oct. 1, 1998

[51] Int. Cl.[7] ..... F21L 5/00

[52] U.S. Cl. ..... 362/205; 362/206; 362/208; 362/202

[58] Field of Search ..... 362/205, 206, 362/208, 202, 203, 212, 184

[56] References Cited

U.S. PATENT DOCUMENTS 3,818,268 6/1974 Peltz ..... 315/244

4,274,130 6/1981 Elliott ..... 362/184

4,615,681 10/1986 Schwarz ..... 434/236

*Primary Examiner*—Cassandra Spyrou

*Assistant Examiner*—Mohammad Y. Sikder

*Attorney, Agent, or Firm*—Thomas B. Tate

[57] ABSTRACT

A programmable signal light which can be used as a flashlight, an alarm light, a signal light, or a lantern. The light has a battery, a circuit board, a three-position switch, and a thumbwheel which can be set for any period up to ninety-nine hours. The light remains off until the predetermined number of hours has elapsed, then turns on.

1 Claim, 3 Drawing Sheets

PROGRAMMABLE SIGNAL LIGHT

BACKGROUND OF THE INVENTION

For certain types of outdoor activities, for example, finding a deer stand while hunting at night, setting a light in a slough while duck hunting in order to reserve a space in the morning, or finding a campsite at night, it would be desirable to have a portable light source which can be programmed to be on only when light is needed. Flashlights currently on the market do not have this capability.

SUMMARY OF THE INVENTION

The invention has time delay feature which allows the user to set the light to turn on at any predetermined time up to ninety-nine hours later. Thus the light can be set and then hung on an object such as a tent, car, or tree to turn on and serve as a guiding light when the person is returning to this location at the predetermined time. The light can also be used as a regular flashlight, since it can be turned on continuously as well as on time delay. An additional advantage of this light is that it can be seen from a three hundred sixty degree radius.

DESCRIPTION OF THE INVENTION

Figure 1:
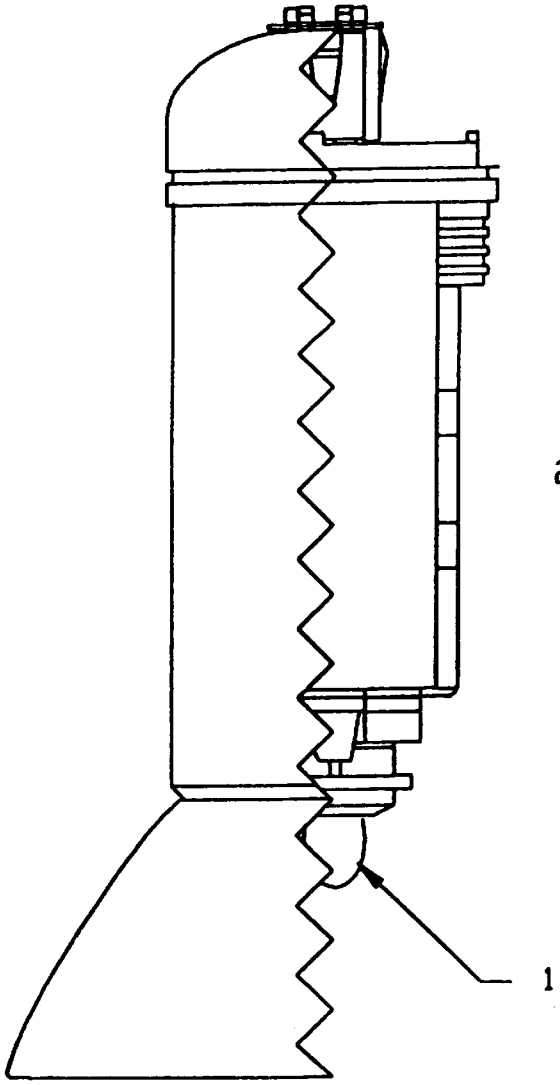
FIG. 1 is a front view with the right half cut away to reveal the internal components.
Figure 2:
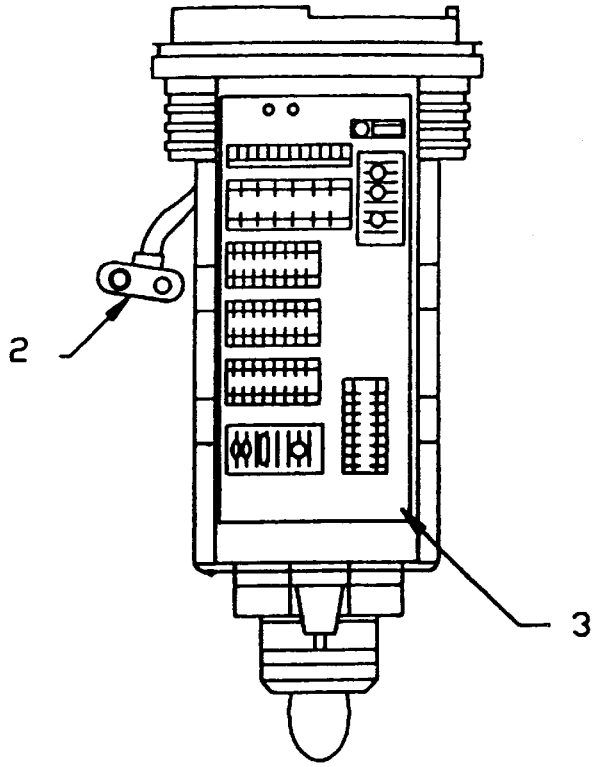
FIG. 2 is a side view of the internal components.
Figure 3:
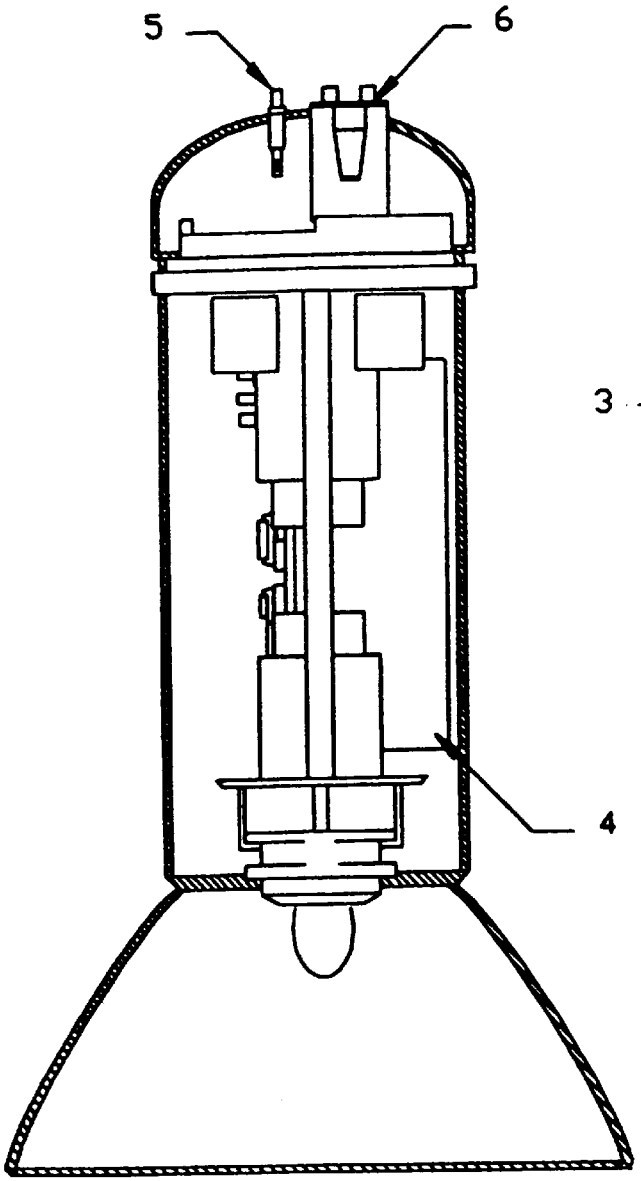
FIG. 3 is a front view with the front half removed to reveal the internal components.
Figure 4:
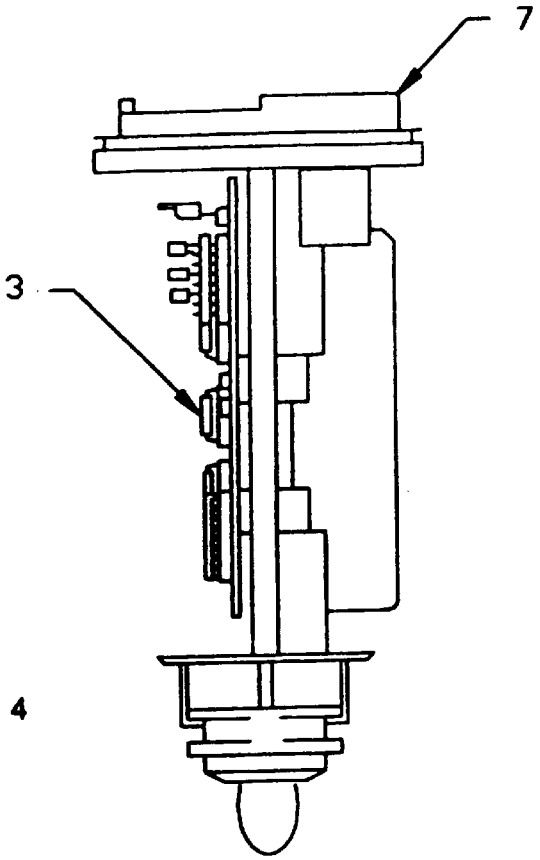
FIG. 4 is a front view of the internal components.
Figure 5A:
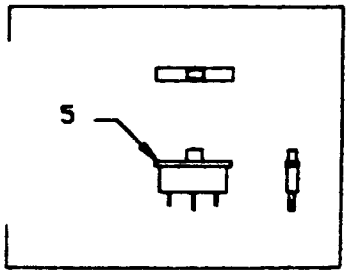
FIG. 5 is a top end view and exploded detail view of the components shown therein.
Figure 5:
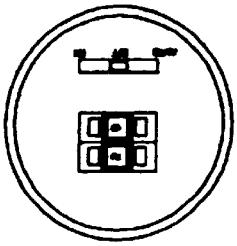
Figure 5B:
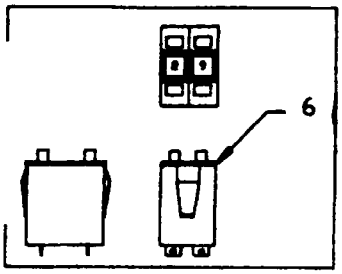
Figure 6:
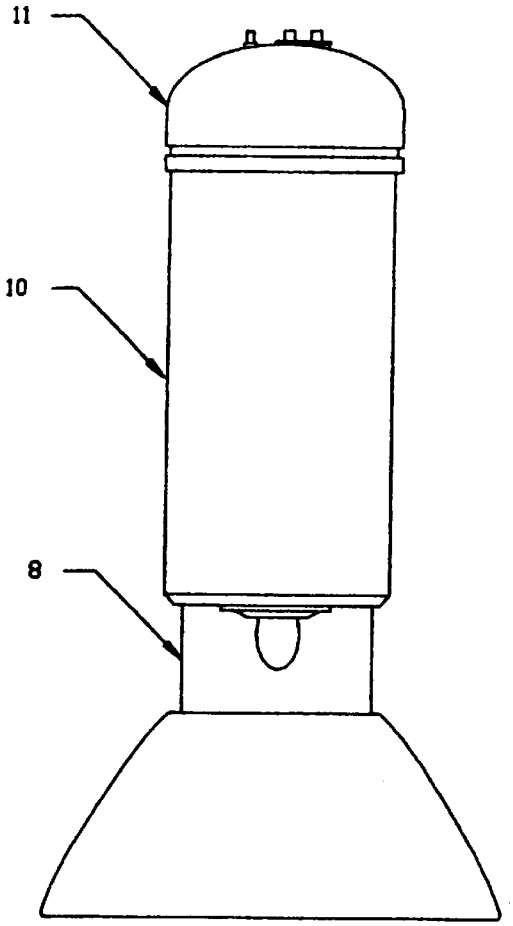
FIG. 6 is a front view.
Figure 7:
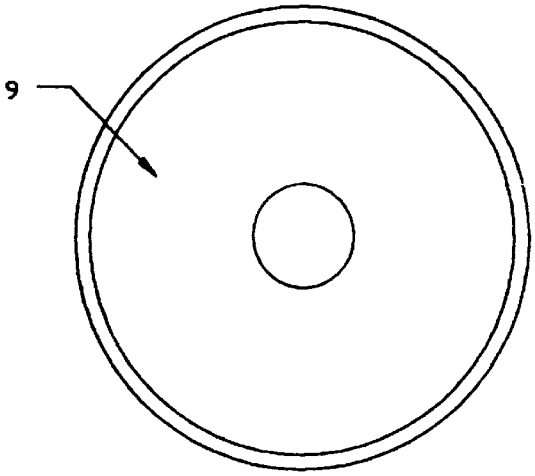
FIG. 7 is a bottom end view.

The invention is a programmable signal light which can be used as a flashlight, an alarm light, a signal light, or a lantern. The flashlight barrel is an opaque plastic enclosure 10. At one end of the barrel 10 there is positioned an incandescent light bulb 1 which is surrounded by reflective liner material 9. At the opposite end of the barrel 10 there is formed a plastic sleeve 7, upon which an opaque plastic end cap 11 is mounted. The cap 11 can be twisted on and off of the sleeve 7. If the flared part of the barrel 10 is pushed forward into spaced relationship with the rest of the barrel 10 as shown in FIG. 6, a clear tubular lens 8 is revealed. The bulb 1 can be seen through the lens 8 when the light is being used as a lantern. In this configuration, light from the bulb 1 can be seen in a three hundred sixty degree radius.

A nine-volt direct current (DC) battery 4 is disposed inside the barrel 10 and is connected to a nine-volt DC battery connector 2. A printed circuit board 3 which includes conventional capacitors and resistors is disposed within the barrel 10 on the opposite side from battery 4.

A thumbwheel 6 which has a zero to ninety-nine hour timer is mounted on the end cap 11. A three-position selector switch 5, which has off, continuous on, and automatic time delay positions, is mounted on the end cap 11 next to the thumbwheel 6. To use the programmable time delay feature, the battery 4 is plugged in, the switch 5 is activated to the time delay position, the thumbwheel 6 is dialed to the desired number of hours (which can be up to ninety-nine hours in the future). Once the thumbwheel 6 has been set, the light bulb 1 will remain off until the predetermined number of hours has elapsed (the thumbwheel setting will have reached zero at that point). At that time, the bulb 1 will turn on. The light can serve as a guiding light by hanging it on a fixed object so that the end cap 11 is at the top.

The light can be used as a conventional flashlight by flipping the switch 5 to the continuous on position.

What is claimed is:

1. A programmable signal light comprising:

a flashlight barrel having a light bulb positioned at one end thereof, said barrel being flared at the end thereof which is proximal to said light bulb, said flared end of said barrel being capable of being pushed forward into spaced relationship with the remainder of said barrel to reveal a clear tubular lens which surrounds said light bulb, thus allowing light from said light bulb to be seen in a three hundred sixty degree radius;

a removable end cap mounted onto a sleeve formed at the end of said barrel which is distal to said light bulb;

a nine-volt direct current battery disposed within said barrel;

a circuit board disposed within said barrel on the opposite side thereof from said battery;

a three-position selector switch mounted on said end cap, said switch having off, continuous on, and automatic time delay positions;

a thumbwheel mounted on said end cap, said thumbwheel being capable of being set to a predetermined number of hours up to a maximum of ninety-nine hours, wherein said signal light remains off until said predetermined number of hours has elapsed, then turns on.

* * * * *